United States Patent [19]

Ledbetter

[11] Patent Number: 4,756,527

[45] Date of Patent: Jul. 12, 1988

[54] GRIPPING ASSEMBLY FOR USE WITH CABLE EXERCISING EQUIPMENT

[76] Inventor: Daniel R. Ledbetter, 231 E. 18th St.-#C, Costa Mesa, Calif. 92627

[21] Appl. No.: 38,050

[22] Filed: Apr. 14, 1987

[51] Int. Cl.[4] ..... A63B 21/12

[52] U.S. Cl. ..... 272/143; 272/119

[58] Field of Search ..... 272/143, 145, 122, 123, 272/119, 67, 68, 112, 75, 125, 126, 118, 135, 136, 139; 119/106

[56] References Cited

U.S. PATENT DOCUMENTS 4,109,905 8/1978 Meier ..... 272/143 X 4,355,801 10/1982 Thomsen ..... 272/119

FOREIGN PATENT DOCUMENTS 2544617 10/1984 France ..... 272/145

*Primary Examiner*—Richard J. Apley

*Assistant Examiner*—Howard Flaxman

*Attorney, Agent, or Firm*—Lyon & Lyon

[57] ABSTRACT

A gripping assembly adapted for use with cable-type exercising devices which employs a hand locking member for securing the assembly to the user's hand during use. The assembly includes a tubular gripping member, an elongate rear hand locking member spaced from and extending substantially parallel to said gripping member and having an axial channel extending therethrough, a latching assembly for securing the gripping assembly to the cable of the exercising device and a strap member defining a closed loop in cross section which extends through and between the latching assembly, the tubular gripping member and the rear hand locking member such that upon inserting one's hand between the gripping member and rear hand locking member, grasping the gripping member and pulling thereon to raise the weights within the cable-type exercise device, the strap member pulls the rear hand locking member toward the gripping member and against the backside of the user's hand to thereby secure the grip assembly to the user's hand and obviate the need for the user to continuously tightly grip the gripping member during exercise.

6 Claims, 1 Drawing Sheet

GRIPPING ASSEMBLY FOR USE WITH CABLE EXERCISING EQUIPMENT

BACKGROUND OF THE INVENTION

Recent years have seen an increasing awareness of the benefits of physical exercise and widespread use of exercising devices. One of the most common and widely used types of exercising device is the cable-type which typically employs an upright frame, an adjustable number of weights secured to a metal cable which extends about one or more pulleys carried by the frame to a hand grip. Depending on the location and orientation of the pulleys, different muscles or muscle groups can be exercised by repetitively pulling on the grip to raise the weights and then slowly returning the grip to its initial position to lower the weights. The hand grips used in such devices are generally of a "D"-shaped configuration comprising a short cylindrical metal gripping bar, the ends of which are secured to a curvilinear support to which the end of the cable or cable attachment is affixed. When doing many different exercises with such devices such as reverse curls and reverse tricep extensions it is necessary to continuously and tightly grip the gripping bar with one's hand and fingers. If the grip were relaxed during such exercises, the weights would fall.

As a result of the configuration of the hand grips used with the aforesaid cable exercising devices, considerable energy is continuously expended during many chest, shoulder and arm exercises in merely holding onto the grip. In addition, a considerable load is placed on the wrist as opposed to the chest, shoulder or portion of the arm for which the exercise was intended. This reduces the weight which can be lifted in such exercises and thus increases the effectiveness of the exercises. Further, people with arthritic fingers, hands or wrists generally cannot use such devices or, to the extent that they can, they are very limited as to the weight which can be attached to the cables.

In addition to the deleterious effects of continuously pulling against one's fingers during certain types of exercise, conventional cable grips can also be extremely uncomfortable to use during those exercises in which the cable rubs and/or snaps against the body. Given the widespread use of cable exercising equipment, it would be highly desirable to develop a hand grip for such equipment which could be readily substituted for the existing conventional grips and relieve the pressure on the hands, fingers and wrists during use without affecting the operation of the equipment, enabling the user to pull extra weight safely and comfortably. It would also be desirable to configure such a handle grip such that it obviated the need for a metal cable in close proximity to the grip to eliminate the physical discomfort caused during many exercises by that portion of the metal cable adjacent the hand grip. Such a hand grip is disclosed herein.

SUMMARY OF THE INVENTION

Briefly, the present invention is directed to a grip assembly for use on conventional cable exercise devices and comprises a tubular gripping member, a flexible rear hand locking member and a smooth and durable strap member extending between and through the gripping member and locking member to a latch mechanism for securing the strap and grip assembly to the extended end of the cable of the exercise device. Upon inserting one's hand between the grip member and locking member, grasping the gripping member and pulling on the cable so as to raise the weights on the exercise device, the force generated along the strap by the weights draws the rear hand locking member toward the gripping member and against the back of the user's hand thereby securing the grip to the hand and allowing the user to relax their grip on the gripping member while utilizing the cable exercising device during all forms of exercise.

It is the principle object of the present invention to provide a grip assembly for use on conventional cable exercising devices which allows the user to relax their grip on the assembly during all uses of the exercise device.

It is another object of the present invention to provide a grip assembly for use on conventional cable exercise devices which tightens about the user's hand during use such that the weights can be raised and lowered by the user during all forms of upper body exercise without the need to tightly grasp the grip assembly.

It is the further object of the present invention to provide a grip assembly for use on conventional cable exercise devices which reduces the load of the weights on the user's fingers and wrists during use to allow the user to employ heavier weights in executing reverse curl and similar exercises.

It is still a further object of the present invention to provide a grip assembly for use on conventional cable exercising devices which is more comfortable to use and adjustable to individual hand sizes.

It is yet another object of the present invention to provide a grip assembly for use on conventional cable exercising devices which is of light weight construction and reduces the chance of injury upon sudden release of the grip assembly.

These and other objects and advantages of the present invention will become apparent from the following detailed description taken in conjunction with the accompanying drawings.

IN THE DRAWINGS

DESCRIPTION OF THE PREFERRED EMBODIMENT

Figure 1:
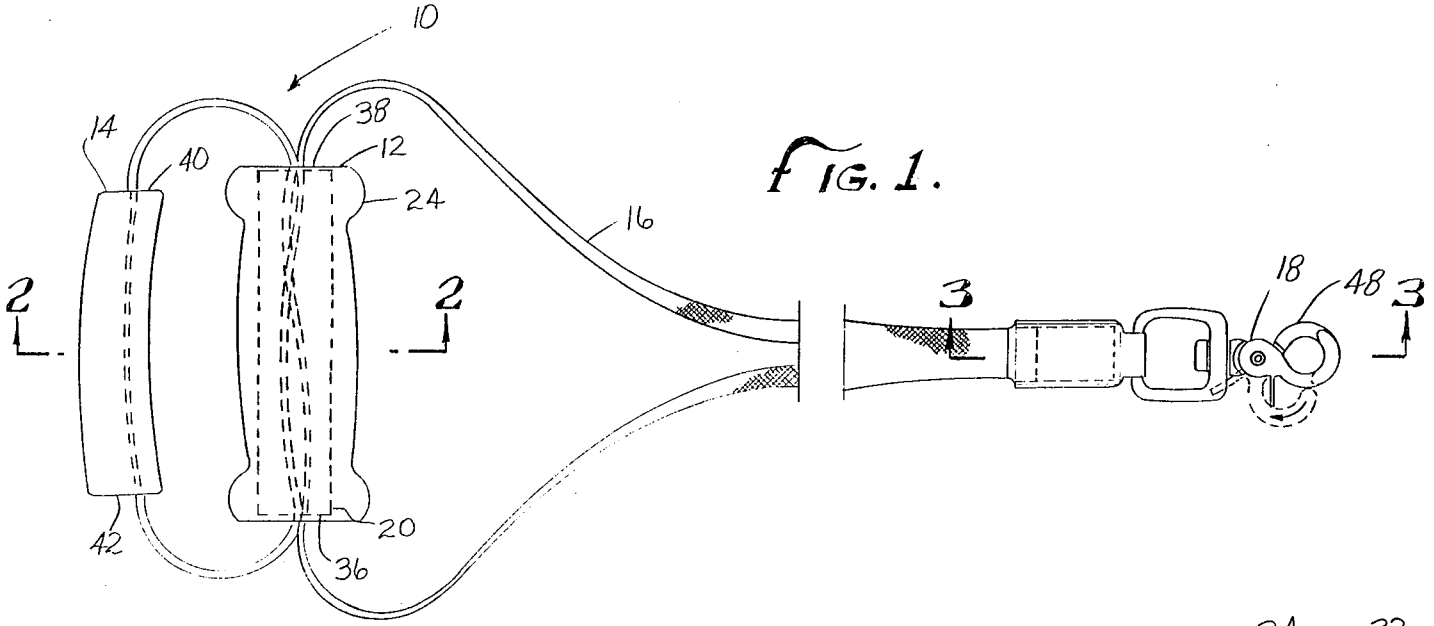
FIG. 1 is a top view of the grip assembly of the present invention.
Figure 3:
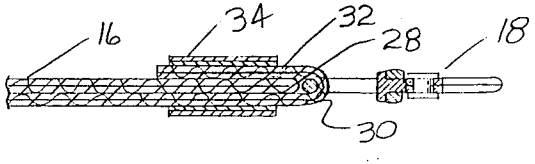
FIG. 3 is a sectional view taken along lines 3—3 of FIG. 1.
Figure 2:
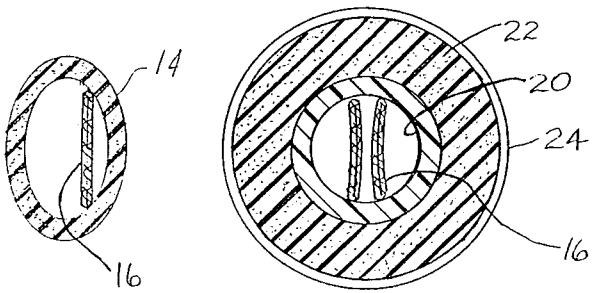
FIG. 2 is a sectional view taken along lines 2—2 of FIG. 1.

The gripping assembly 10 of the present invention is comprised of a tubular gripping member 12, rear hand locking member 14, strap 16 and latching assembly 18. The gripping member 12 is constructed of a hollow open-ended inner tube 20 preferably constructed of fiberglass or PVC pipe and encased in a contoured layer of resilient foam material 22. The foam material 22 preferably defines enlarged radius portions 24 at the upper and lower ends thereof to aid in properly grasping the gripping member 12. The rear hand locking member 14 is preferably comprised of a flexible tube of foam material such as neoprene sponge, is preferably elliptical in cross section and defines a slightly concave inner surface 26 to comfortably mate with the backside of the user's hand.

The strap 16 is preferably constructed of a nylon mesh material formed into a flat tube so as to provide substantial shear and tensile strength and avoid any sharp edges which might otherwise tear the interior surface of the foam rear hand locking member 14. Strap 16 is of a finite length with one end 28 thereof abutting a loop portion 30 of the latching assembly 18 and the other end 32 extending about the loop portion 30 and being folded over end 28 and secured thereto by a suitable securement member 34. An aluminum cable crimp with a plastic heat shrinkable covering has been found to be well-suited for this purpose. Other means could, of course, be employed for securing the ends of strap 16 to latching assembly 18.

Between the ends 28 and 32, strap 16 extends back through the lower open end 36 of the gripping member 12, out the upper end 38 thereof, down the open upper end 40 of the rear hand locking member 14 and out the open lower end 42 thereof. The strap 16 then extends back to and through the gripping member 12, out the upper end 38 thereof and back to the latching assembly 18. So disposed, the rear hand locking member 14 is secured to but spaced from the tubular gripping member 12 so as to enable the user to extend his hand therebetween and grip the gripping member 12 as will be described. The length of the strap 16 can be varied to suit the user and/or the particular exercising device on which the gripping assembly 10 is to be used.

The latching assembly 18 includes the loop portion 30 to which the strap 16 is secured and a swivel spring latch assembly 48 which is secured to loop portion 30 and is operable to detachably secure the gripping assembly 10 to a conventional loop connection secured to the extended end of the exercising device cable (not shown).

In use, the gripping assembly 10 is secured by the latch assembly 18 to the end of the exercising device cable and the user inserts his or her hand between the gripping member 14 and the rear hand locking member 14 and grasps the gripping member 12. As the user pulls on the gripping member to raise the weights in the exercising machine carried by the cable, strap 16 pulls the rear hand locking member 14 snugly against the backside of the user's hand so that when using the gripping assembly 10 to do reverse curls or other exercises wherein the gripping member would otherwise be pulled against the user's fingers, the user can relax his or her grip and the weights would be carried by the rear hand locking member 14 pressing against the back of the user's hand. This greatly reduces the stress on the user's fingers and wrists during such exercises thereby allowing the user to exercise with heavier weights than he or should could with conventional hand grips.

Because of the gripping action exerted by the rear-hand locking member 14 on the back side of the user's hand, the gripping assembly actually grips the user's hand during use. Accordingly, the device with a slight modification could be utilized by persons who have lost a hand or foot to exercise their arm or leg on a pulley-type exercise device. In this embodiment of the invention, the inner tube 20 would be curved so as to more comfortably fit against the user's arm or leg and the rear-hand locking mechanism 14 would be disposed between the curved tube and latch assembly. In use the limb to be exercised would be held between the curved tube and locking member securing the device to the limb.

Various changes and modifications may be made in carrying out the present invention without departing from the spirit and scope thereof. Insofar as these changes and modifications are within the purview of the appended claims, they are to be considered as part of the present invention.

I claim:

1. A gripping assembly adapted for use with a cable type exercising device, said assembly comprising an elongate tubular gripping member, and elongate hand locking member constructed of a deformable resilient material and spaced rearwardly from said gripping member and extending substantially parallel thereto, a latching assembly disposed forwardly of said gripping member, and a strap member extending rearwardly from said latching assembly through and between said gripping member and said rear hand locking member and forwardly to said latching assembly such that upon said latching assembly being pulled from said gripping member, said strap member urges said rear hand locking member toward said gripping member thereby securing the gripping assembly to a user's hand and eliminating the need for the user to continue to grasp the gripping member during use of the exercise device.

2. A gripping assembly adapted for use with a cable-type exercising device, said assembly comprising an elongate gripping member having an open-ended rigid tubular inner portion and a deformable resilient outer portion, and elongate resilient rear hand locking member spaced rearwardly from and extending substantially parallel to said gripping member, a latching assembly, disposed forwardly of said gripping member, a strap member extending rearwardly from said latching assembly back to said gripping member, axially through said gripping member and rearwardly to said rear hand locking member, axially through said rear hand locking member and forwardly to said gripping member, axially through said gripping member and forwardly to said latching assembly, and means for securing said strap member to said latching assembly forwardly of said gripping member such that upon inserting a user's hand between said gripping member and said rear hand locking member, grasping said gripping member and pulling on said gripping member, said strap pulls said rear hand locking member toward said gripping member against the user's hand thereby securing the gripping assembly to the user's hand and eliminating the need for the user to continue to grasp the gripping member during the use of the exercise device.

3. The combination of claims 1 or 2 wherein said rear hand locking member defines an open-ended channel extending axially therethrough, said strap extending through said channel.

4. The combination of claim 3 wherein the transverse cross section of said strap member defines a relatively flat continuous loop.

5. A gripping assembly adapted for use with a cable-type exercise device, said assembly comprising a gripping member having an open-ended rigid tubular inner core and an open-ended deformable resilient tubular handle disposed about said core, an elongate resilient rear hand locking member spaced rearwardly from and extending substantially parallel to said gripping member and defining a channel extending axially therethrough, a latching assembly disposed forwardly of said gripping member for securing said gripping assembly to the cable-type exercising device, a strap member extending rearwardly from said latching assembly to said gripping member, axially through said inner core of said gripping member, rearwardly to said locking member, through said channel in said locking member, forwardly to said gripping member, axially through said inner core of said gripping member and forwardly to said latching member, and means for securing said strap member to said latching assembly.

6. The combination of claim 5 wherein the transverse cross section of said strap member defines a relatively flat continuous loop of flexible material such that the exterior surface thereof intermediate the ends of said strap member is devoid of edges.

* * * * *